US007972560B2

(12) United States Patent
Sutter et al.

(10) Patent No.: US 7,972,560 B2
(45) Date of Patent: Jul. 5, 2011

(54) APPARATUS FOR DISPENSING MATERIAL

(75) Inventors: Peter Werner Sutter, Beach, NY (US); Eli Anguelova Sutter, Beach, NY (US)

(73) Assignee: Brookhaven Science Associates, LLC, Upton, NY (US)

( * ) Notice: Subject to any disclaimer, the term of this patent is extended or adjusted under 35 U.S.C. 154(b) by 464 days.

(21) Appl. No.: 12/102,370

(22) Filed: Apr. 14, 2008

(65) Prior Publication Data

US 2009/0257921 A1 Oct. 15, 2009

(51) Int. Cl.
*B01L 3/02* (2006.01)

(52) U.S. Cl. ..... 422/100; 977/762; 977/888; 977/890

(58) Field of Classification Search ..... 422/100; 977/762, 888, 890

See application file for complete search history.

(56) References Cited

U.S. PATENT DOCUMENTS

| | | | | |
|---|---|---|---|---|
| 6,149,815 | A | 11/2000 | Sauter | 210/635 |
| 6,670,607 | B2 | 12/2003 | Wood et al. | 250/288 |
| 6,864,480 | B2 | 3/2005 | Staats | 250/288 |
| 7,334,881 | B2 | 2/2008 | Punsalan et al. | 347/76 |
| 2004/0115830 | A1 | 6/2004 | Touzov | 436/180 |
| 2005/0266149 | A1 | 12/2005 | Henderson et al. | 427/2.11 |
| 2006/0115971 | A1* | 6/2006 | Bau et al. | 438/591 |

OTHER PUBLICATIONS

C. Journet and P. Bernier, Production of Carbon Nanotubes, 67 Appl. Phys. A 1-9 (1998).*

J.-Y. Chang et al., Opening and Thinning of Multiwall Carbon Nanotubes in Supercritical Water, 363 Chem. Phys. Lett. 583-590 (2002).*

F. Banhart et al., Carbon Nanotubes Under Electron Irradiation: Stability of the Tubes and Their Action as Pipes for Atom Transport, 71 Phys. Rev. B 241408-1-241408-4 (2005).*

A. Celik-Aktas et al., Electron Beam Machining of Nanometer-Sized Tips from Multiwalled Boron Nitride Nanotubes, 102 J. Appl. Phys. 024310-1-024310-5 (2007).*

Lanzara research group webpage, available at http://www.physics.berkeley.edu/research/lanzara/research/Graphite.html (last visited Aug. 9, 2010).*

Sutter, et al., "Dispensing and Surface-Induced Crystallization of Zeptolitre Liquid Metal-Alloy Drops", Nature Materials, vol. 6, May 2007, pp. 363-366.

Barton, et al., "Mass-Limited Growth in Zeptoliter Beakers: A General Approach for the Synthesis of Nanocrystals", Nano Letters, vol. 4, No. 8, 2004, pp. 1525-1528.

Hamra, et al., "Near-Field Optical Zeptoliter pH Sensing At & Above Surfaces", Microsc Microanal, 13 (Suppl 2), 2007.

Meister, et al., "Nanodispenser for Attoliter Volume Deposition Using Atomic Force Microscopy Probes Modified by Focused-Ion-Beam Milling", Applied Physics Letters, vol. 85, No. 25, Dec. 20, 2004, pp. 6260-6262.

Banhart, F., "Irradiation Effects in Carbon Nanostructures", Rep. Prof. Phys., 62, 1999, pp. 1194-1199.

Sun, et al., "Carbon Nanotubes as High-Pressure Cylinders and Nanoextruders", Science, vol. 312, May 26, 2006, pp. 1199-1202.

* cited by examiner

*Primary Examiner* — Glenn Caldarola
*Assistant Examiner* — Randy Boyer
(74) *Attorney, Agent, or Firm* — Dorene M. Price

(57) ABSTRACT

An apparatus capable of dispensing drops of material with volumes on the order of zeptoliters is described. In some embodiments of the inventive pipette the size of the droplets so dispensed is determined by the size of a hole, or channel, through a carbon shell encapsulating a reservoir that contains material to be dispensed. The channel may be formed by irradiation with an electron beam or other high-energy beam capable of focusing to a spot size less than about 5 nanometers. In some embodiments, the dispensed droplet remains attached to the pipette by a small thread of material, an atomic scale meniscus, forming a virtually free-standing droplet. In some embodiments the droplet may wet the pipette tip and take on attributes of supported drops. Methods for fabricating and using the pipette are also described.

14 Claims, 3 Drawing Sheets

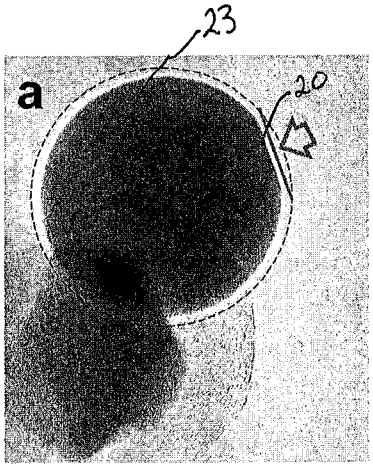
FIG. 2A
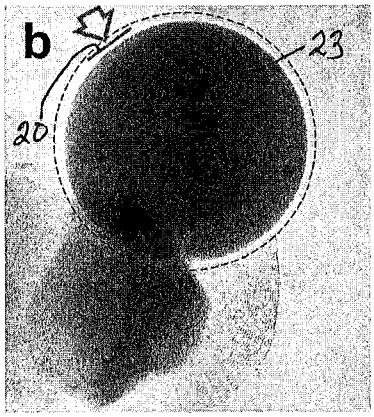
FIG. 2B
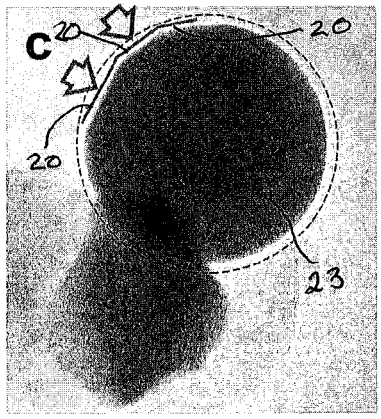
FIG. 2C
FIG. 4A
FIG. 4B
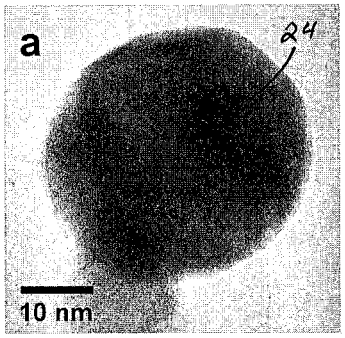
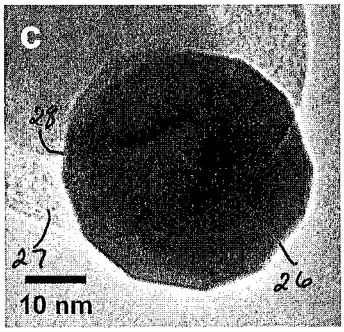
FIG. 4C
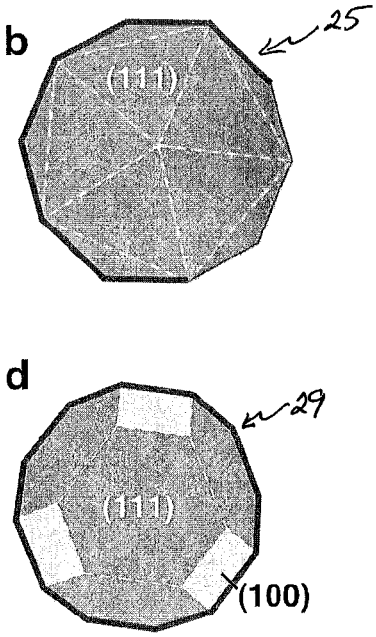
FIG. 4D

305°C

285°C

APPARATUS FOR DISPENSING MATERIAL

This invention was made with Government support under contract number DE-AC02-98CH10886, awarded by the U.S. Department of Energy. The Government has certain rights in the invention.

BACKGROUND OF THE INVENTION

The invention relates to the field of dispensing material and, in particular, to the dispensing of material on the zeptoliter scale. It further relates to apparatus useful in such dispensing.

The controlled delivery of fluids is a key process in nature and in many areas of science and technology, where pipettes or related devices are used for dispensing well-defined fluid volumes. Existing pipettes are capable of delivering fluids with attoliter ($10^{-18}$ l) accuracy at best. See Meister, A., et al., "Nanodispenser for attoliter volume deposition using atomic force microscopy probes modified by focused-ion-beam milling," *Appl. Phys. Lett.* 85, 6260-6262 (2004). Studies on phase transformations of nanoscale objects would benefit from the controlled dispensing and manipulation of much smaller droplets. In contrast to nanoparticle melting whose fundamental pathway has been studied extensively (Frenken, J. W. M. & van der Veen, J. F., "Observation of surface melting," *Phys. Rev. Lett.* 54, 134 (1985)), experiments on crystallization, testing classical nucleation theory, are hindered by the influence of support interfaces. Experiments on free-standing fluid drops are extremely challenging. See Egry, I., Lohoefer, G. & Jacobs, G., "Surface tension of liquid metals: Results from measurements on ground and in space," *Phys. Rev. Lett.* 75, 4043 (1995).

SUMMARY

Recognizing the desirability of dispensing smaller droplets than the attoliter drops currently available, both to study fundamental scientific principles and to provide means of controllably generating patterns of ultrasmall volumes of materials, the inventors have designed and operated a pipette capable of dispensing volumes in the zeptoliter ($10^{-21}$ l) range. In some embodiments, the pipette may be observed by transmission electron microscopy (TEM) to deliver molten metals and metal-alloys with zeptoliter (zl) precision. In some embodiments the pipette may be used to produce nearly free-standing droplets suspended by an atomic-scale meniscus at the pipette tip. In some cases the size of the droplet dispensed by the pipette depends on the size of an aperture, or channel, formed in a shell surrounding the reservoir of the pipette.

In an embodiment, the pipette includes a nanowire with a length from a few nanometers to a few micrometers that makes up the body of the pipette, a reservoir at the tip of the pipette filled with material to be dispensed, and a multi-layer carbon shell encapsulating the body, tip, and reservoir of the pipette. In some embodiments the reservoir is located along the body of the pipette rather than at its tip.

In some embodiments a dispensing apparatus includes a nanowire coated with one or more layers of graphene, a reservoir in contact with the nanowire also coated with at least one layer of graphene, and a channel through the carbon encapsulant to the reservoir. The reservoir need not be at the tip of the nanowire, but may be at any convenient position along it.

Methods for making such a pipette are described with reference to particular embodiments of the process and the pipette produced by them. One method of making a zeptoliter dispensing apparatus is to form it in situ by encapsulating a semiconducting nanowire with one or more layers of graphene, a form of carbon, and then forming a hole, or channel, in the carbon shell. An ex situ process of generating a dispenser of zeptoliter-sized droplets is similar, but before the apparatus is used it is transferred to a chamber where it can be heated and irradiated, by an electron beam or other high-energy beam.

Modes of operation of the pipette in general and in selected cases are outlined. In some embodiments the zeptoliter pipette reservoir includes an amount of molten material to be dispensed. Upon opening the channel this material is subjected to pressure from the surrounding carbon encapsulant and is forced from the reservoir. The droplet may be dispensed onto a support, or it may be maintained in a virtually freestanding state supported only by the meniscus. In some embodiments the reservoir contains a solid material to be dispensed. The entire dispensing apparatus may be heated to a temperature above the melting point of the dispensable material. When molten, the material may be expelled from the pipette. The material to be dispensed need not be a metal or a metal alloy but can be any material that does not form a deleterious reaction product with the nanowire or encapsulant, and that has a melting point in a convenient temperature range for study or manufacture.

In some embodiments the pipette may act to affect fluid flow. The carbon shell encompassing the pipette/reservoir ensemble may be tightened by irradiation with an electron beam, increasing pressure on the reservoir and the material contained in it. A channel may be opened through the carbon shell into the reservoir at a desired location. Fluid flow may be initiated in a desired direction by the action of the relaxing carbon shell and the placement and shape of the channel. More than one channel may be formed in the pipette shell, in the area of the reservoir, external to the area of the reservoir, or both.

The foregoing being but a summary of the inventive features described herein, it is necessarily brief. A more complete understanding may be gained by consulting the detailed description making reference to the drawings described here briefly. None of the summarizing comments provided here are intended in any way to limit the invention, whose scope is to be determined solely by the claims appended hereto.

BRIEF DESCRIPTION OF THE DRAWINGS

FIG. 2A shows transient faceting of a 30-nm $Au_{72}Ge_{28}$ drop near the liquid-solid phase transition.

FIG. 2B shows transient faceting of a 30-nm $Au_{72}Ge_{28}$ drop near the liquid-solid phase transition.

FIG. 2C shows transient faceting of a 30-nm $Au_{72}Ge_{28}$ drop near the liquid-solid phase transition.

FIG. 4B shows a projection of a drop having symmetry similar to that of the "free" $Au_{72}Ge_{28}$ drop illustrated in FIG. 4A.

FIG. 4D shows a projection of a drop having symmetry similar to that of the "supported" $Au_{72}Ge_{28}$ drop illustrated in FIG. 4C.

DETAILED DESCRIPTION

Figure 1A:
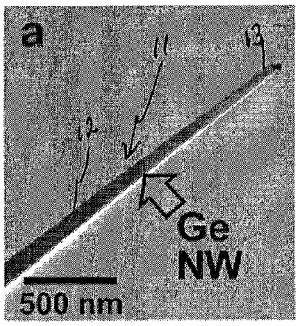
FIG. 1A is a low-resolution transmission electron microscope (TEM) image showing a germanium (Ge) nanowire.

The inventive technology is described herein with reference to certain embodiments for the sake of clarity. A person having ordinary skill in the art, making use of the teaching herein, may extend or modify certain aspects of an embodiment without departing from the scope of the invention, which scope is determined entirely by the claims appended hereto.

A method for forming nanowires having carbon coatings is described in U.S. patent application Ser. No. 11/854,168, "Assembly of Ordered Carbon Shells on Semiconducting Nanomaterials," filed Sep. 12, 2007, and having as inventors Eli Sutter and Peter Sutter. Said application is hereby incorporated by reference in its entirety for all purposes. For convenience an abbreviated description follows.

Semiconducting nanomaterials may be fabricated in any of several ways, and no few of them may be bought from commercial suppliers. Some of the formation methods employ metal catalysts to direct the size and shape of the resulting nanomaterial. Other methods do not require catalysts. The choice of method for forming semiconducting nanomaterials depends on the composition of the material and on the desired shape of the resultant semiconducting nanomaterial, i.e. quantum dot, nanowire, nanotube, etc. Some of the methods employed to form semiconducting nanomaterials include laser ablation, chemical vapor deposition (CVD), molecular beam epitaxy (MBE), chemical vapor transport reactions, and low-temperature solution-phase synthesis. Other methods are also well known in the art. For example, high-aspect-ratio nanowires of germanium (Ge) may be fabricated by CVD using gold-germanium (Au/Ge) catalyst particles. Gold from the catalyst particles segregates to the surface of the nanowires where it typically forms metal islands rather than smooth monolayers of metal.

Samples may be placed on amorphous carbon supports, which also serve as a source of carbon (C), and loaded into a transmission electron microscope (TEM) under vacuum conditions, i.e. at pressures below about 1 torr, down to about 1 or $2\times10^{-5}$ torr or less. In an inert gas atmosphere vacuum is not required. Other sources of C may include other carbon-containing support materials or carbon-carrying precursor gases such as hydrocarbon gases including ethylene and acetylene. During in situ annealing, that is annealing in the observation chamber, the sample is also exposed to an electron beam. In general, during the process of forming the ordered carbon encapsulant the sample may be subject to irradiation by an electron beam with electron energy between 100 eV and 1 MeV.

At the interface between a Ge nanowire (NW) so grown and its germanium oxide ($GeO_x$) surface layer, the oxide is amorphous and its interface with the Ge surface is atomically sharp. Upon heating the wires to 180° C. the thickness of the oxide layer can be observed to decrease over a course of minutes, sometimes about 5 minutes, under electron beam irradiation, creating large areas of the NW surface that are entirely free of oxide. The remaining oxide patches may be completely removed after the temperature is increased to about 290° C. The removal of the oxide may be caused by thermal or electron-beam-induced desorption or by the oxide's reduction by carbon.

After removal of the surface oxide from Au-decorated Ge NWs, also at a temperature of about 290° C., assembly of graphene C fragments is initiated at the tip of the NW adjacent to the Au—Ge nanoparticle. Continued build-up and organization of the C shell occurs both on the catalyst particle and on the surface of the Ge. Shell formation may start with the assembly of small curved segments at a temperature of about 340° C. These segments gradually build up several layers covering the whole NW (T=340° C.) and eventually straighten and organize into stacks of extended curved graphene sheets (T=355° C.). From high-resolution TEM images, such as those of FIGS. 1, 2, and 4, the spacing of the graphene layers is determined to be about 0.3-0.4 nm, consistent with the c-axis spacing of graphite. From micrographs taken far from the NW tip and the Au/Ge catalyst particle, the entire Ge wire appears embedded in a C shell of several graphene layers. Under a variety of experimental conditions, metal-free Ge nanoparticles, i.e. pristine Ge nanoparticles, have not been observed to develop passivated surfaces. In particular, they do not form protective shells of ordered C. In general the chemistry of the surfaces of semiconductors prohibits the formation of passivating ordered shells of graphitic carbon. More details may be available in the aforementioned patent application by the same inventors, incorporated by reference herein.

The main building blocks and operation of the zeptoliter (zl) pipette 11 are shown in FIG. 1. The entire set-up is mounted on the variable-temperature stage of a transmission electron microscope (TEM), which serves to both actuate and observe the operation of the pipette. A germanium NW 12 constitutes the pipette body, providing the mechanical support necessary to hold the pipette tip steady in vacuum (FIG. 1A). In the embodiment described with reference to FIGS. 1A through 1G, the tip 13 itself (FIG. 1B) includes a reservoir 14 of Au—Ge alloy with a composition close to the eutectic point in the binary phase diagram ($Au_{72}Ge_{28}$). The entire NW 12 and the Au—Ge reservoir 14 are encapsulated in a self-assembled multilayer shell of crystalline carbon 15 (FIG. 1C; see Examples section for details).

To operate the pipette 11, the Au—Ge reservoir 14 is melted by heating above the bulk eutectic temperature ($T_E$=361° C.) (or, indeed, the bulk melting temperature of whatever material is to be dispensed), and the expulsion of liquid metal alloy is triggered by opening a small channel (the pipette 'nozzle' pointed out by the arrow) 16 in the C-shell 15 by briefly focusing a tight (1-nm, e.g.) electron beam onto the shell. An escaping liquid drop 17 is observed outside the shell 15 immediately after returning the TEM to imaging conditions (FIG. 1D). The drop 17 is perfectly spherical and has an initial volume of about 3 zl (diameter ~18 nm). Over several hundred seconds, it slowly grows to over 30 zl in volume. At the same time, the Au—Ge reservoir 14 shrinks continuously. This process is shown in FIGS. 1D, 1E, and 1F, all imaged at the same magnification.

Figure 1B:
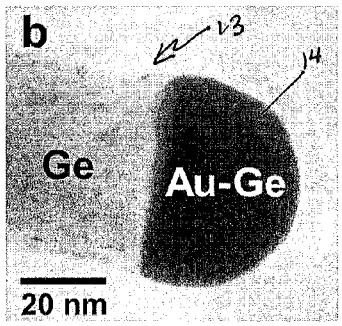
FIG. 1B is a high-resolution TEM image of a reservoir of molten alloy at the tip of a Ge nanowire encapsulated by a multi-layer carbon structure.
Figure 1C:
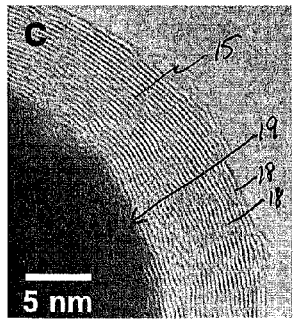
FIG. 1C is a high-resolution close-up image of a part of a reservoir and its interface with a carbon encapsulant.
Figure 1D:
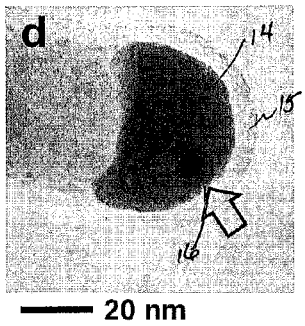
FIG. 1D is a TEM image of a reservoir in which a droplet is forming.
Figure 1E:
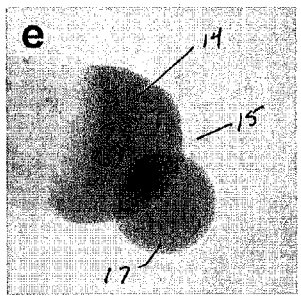
FIG. 1E is a high-resolution TEM image of a droplet emerging from a reservoir.
Figure 1F:
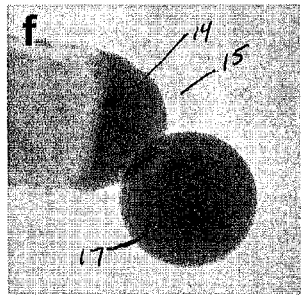
FIG. 1F is a high-resolution TEM image of a droplet virtually fully emerged from a reservoir.
Figure 1G:
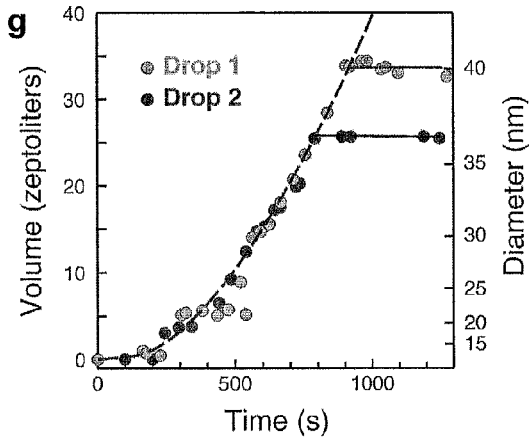
FIG. 1G shows the increase of droplet size over time.

FIG. 1G shows the evolution of the drop volume, determined from time-lapse TEM images, for two fluid-delivery experiments from different zeptoliter pipettes. The expelled fluid volume increases with time until, abruptly on a timescale of a few seconds, the drop volume stabilizes and remains constant. With proper definition of the starting time, the growth of both drops is almost identical, demonstrating that different pipettes operate reproducibly under similar conditions. In contrast to other studies on liquid metals contained in C, for instance gallium/carbon (Ga/C) nanothermometers in which thermal expansion is used to drive fluid flow inside multiwall C-nanotubes, high pressure generated by the C-shell encapsulation of the pipette reservoir plays the role of driving the fluid flow and fluid expulsion in these embodiments. On the basis of shifts in the melting and crystallization temperatures of nanoparticles of low-melting-point metals, such as lead (Pb) and tin (Sn), encapsulated in comparable multilayer C shells, typical pressures inside such structures were estimated to be in the GPa range. Observations of the shell structures, a sandwich of wavy graphene sheets 18 with alternating inward and outward curvature (FIG. 1C), suggest that elastic relaxation of the shell can propel the initial fluid flow from the pipette reservoir. Large-scale rearrangements of the C shell may be observed later, when the rate of fluid expulsion becomes determined increasingly by the restructuring of the shell.

FIG. 1A shows a nanowire pipette body 12, here made of Ge. The pipette body may be formed by any of the techniques, known now or subsequently developed, for forming nanomaterials of desired shape and composition. In particular they may be grown by metal-seeded chemical vapor deposition (CVD). In FIG. 1B, a fluid reservoir 14 is depicted at the pipette tip 13. In the embodiment shown here, the fluid reservoir contains a molten gold-germanium alloy, $Au_{72}Ge_{28}$, encapsulated by a multilayer C shell. The composition of this alloy is chosen to approximate the eutectic composition of the alloy, that composition with the lowest melting temperature of the binary system. The temperature at which the micrograph was obtained is approximately 425° C. In some embodiments this reservoir may incorporate residual metal catalyst. The multi-layer C shell may be formed as described above. FIG. 1C points out the interface 19 between the liquid Au—Ge and the solid carbon shell 15. The multiple curved graphene layers 18 of the C shell can be seen. It may also be possible to form the C shell from single layers of graphene, depending on the use to which the dispenser will be put.

To operate the pipette, that is, to dispense material from the reservoir, a channel is opened through the carbon shell 15 into the reservoir 14. This aperture may be opened by any high-energy source able to focus to a small enough spot size. In the particular embodiment discussed with reference to FIG. 1, a small channel, the pipette nozzle, (see FIG. 1D) is opened in the C-shell by briefly focusing a tight (~1-nm) electron beam onto the shell. The opening of the channel initiates the expulsion of material from the reservoir. While the reservoir here is depicted at the tip of the nanowire, in other embodiments it may be located at another region along the wire.

The chart in FIG. 1G shows the time dependence of the size of dispensed Au—Ge drops as ascertained from two separate pipetting experiments. The lines, guides to the eye, point out the droplet growth. FIGS. 1D to 1F follow the expulsion of a $Au_{72}Ge_{28}$ melt drop 17 during operation of the zeptoliter pipette at a temperature of 425° C.

Although the process has been described with particular materials, such as Ge and $Au_{72}Ge_{28}$, and a particular nanoparticle shape, a nanowire, extensions of the method could, of course, employ alternate seed/particle systems, nanoparticle systems without seed material, and arbitrary nanoparticle shapes.

When dispensing a small drop into vacuum, the effective driving force for fluid flow is the difference between the reservoir pressure, $p_{res}$, and the Laplace pressure due to the surface tension, $\gamma$, of the spherical drop with radius R: $\Delta p = p_{res} - (2\gamma/R)$. Steady flow can only be established if the reservoir pressure exceeds the Laplace pressure of a small (<10 nm) initial drop, which for liquid metals or alloys can be of the order of 1 GPa (for example, $\gamma(Au) = 1.169\ N\ m^{-1}$ at 1,064° C.). The operation of the pipette can be further analyzed using the Hagen-Poiseuille relation, giving the change of fluid volume (V) with time (t), $(dV/dt) = (\pi r^4/8\ \mu l)\ \Delta p$, for the flow rate of a viscous fluid (viscosity, $\mu$), driven through a narrow nozzle (radius, r; length, l) by a pressure difference, $\Delta p$.

In contrast to macroscopic flow, the flow through an atomic-scale nozzle may be dominated entirely by fluid-nozzle interactions, that is, the effective viscosity, $\mu$, derived from the above relation will reflect friction in the nozzle rather than a bulk property of the fluid in the reservoir. This picture is indeed confirmed by a least-squares fit of the viscous flow relation to the measured drop evolution. For exemplary values of nozzle length ($l \approx 10$ nm, the measured C-shell thickness) and radius ($r \approx 1$ nm), the fit yields a reservoir pressure $p_{res} = 0.77$ GPa and viscosity $\mu = 7 \times 10^5$ Pa s. The extreme value of $\mu$, several orders of magnitude higher than the bulk viscosity of metallic melts and well beyond the possible range of viscosity under pressure, suggests significant wetting-induced dissipative fluid-nozzle interactions. Atomistic simulations of nanoscale fluid jets have indeed predicted strong frictional interactions when wetting is not prevented between a model fluid and the surface of a microscopic ejection nozzle. However, whereas simulations over a few nanoseconds show only two flow regimes—rapid ejection as a jet or complete clogging of the nozzle—experiments such as these demonstrate an important third regime accessible in practice: the slow, controlled delivery of individual drops with volume in the zeptoliter range.

The zeptoliter pipette can maintain an expelled fluid drop, held only by a thin thread of molten material, here an alloy melt, emerging from the nozzle in a quasi-containerless environment. This unique pendant drop geometry permits the direct microscopic observation of melting and crystallization of individual, free-standing metal-alloy particles containing $10^4$-$10^6$ atoms, a regime in which significant deviations from macroscopic behavior can be expected, but in which the drops are too large to allow for extended atomistic simulations of their phase behavior.

Figures 3A, 3B, 3C, 3D:
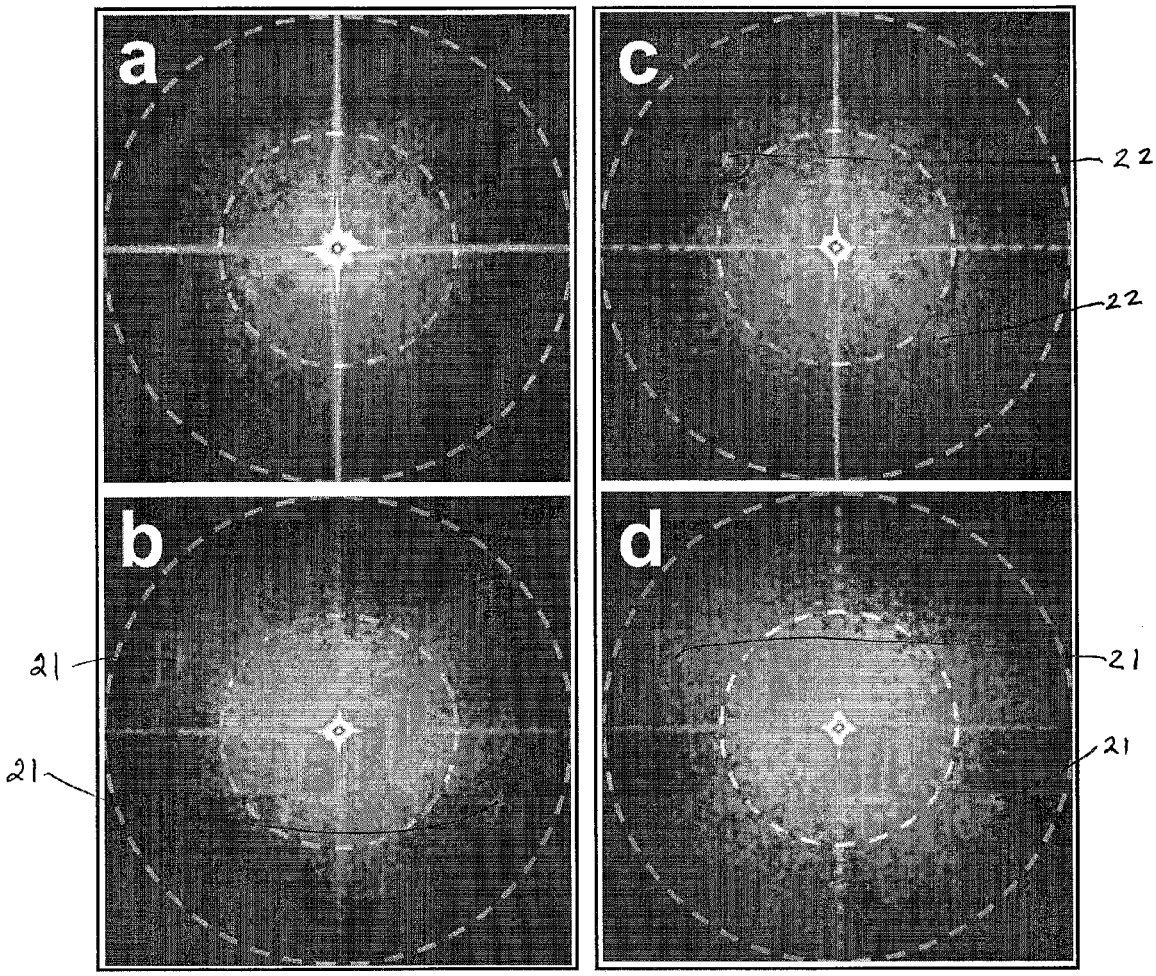
FIG. 3A shows a Fourier transform (FT) of the area depicted in FIG. 2A.
FIG. 3B shows a FT of an area of the Ge nanowire far from the droplet of FIG. 2A.
FIG. 3C shows a FT of a crystallized region of an area imaged in FIG. 2.
FIG. 3D shows a FT of the Ge nanowire near the droplet of FIG. 2 below the Au—Ge crystallization temperature.

Several zeptoliter pipettes were used to observe the crystallization of $Au_{72}Ge_{28}$ drops with diameters between 20 and 40 nm. Small alloy volumes of a few tens of zeptoliters show significant hysteresis between melting and crystallization. The melting temperature is size dependent, but generally lies around 350° C. for the particle sizes considered here. Crystallization occurs around 290-300° C.; that is, substantial supercooling is achieved for free-standing drops. During slow cooling, the drops appear as homogeneous spheres without any internal contrast. However, a few degrees Celsius above the crystallization point, the supercooled drops suddenly develop partial surface facets 20, while remaining perfectly spherical over the remainder of their surface (FIG. 2). Faceted surface segments continuously form and decay by converting back to the spherical shape. This transient surface faceting has been maintained for several hours with the drop temperature stabilized a few degrees above the point at which crystallization was eventually observed. In this regime, the internal volume clearly remains in the liquid state, showing no change in image contrast compared with the appearance of the same drop at higher temperatures. Fourier-transform (FT) analysis of the TEM images confirms the liquid state of drops in the transient faceting regime. Power spectra of image areas containing strongly faceted $Au_{72}Ge_{28}$ drops (such as shown in FIG. 2A) show no distinct reflections that could be associated with crystalline order in the drops (FIG. 3A), whereas clear diffraction spots 21 are invariably observed for the adjacent crystalline Ge nanowire material (FIG. 3B). Once crystallization is induced by lowering the temperature, strong reflections 22 are detected from the solid drops (FIG. 3C), consistent with the spacing of (111) lattice planes in the crystalline AuGe alloy.

FIGS. 2A to 2C depict the transient faceting of a 30-nm $Au_{72}Ge_{28}$ drop 23 near the liquid-solid phase transition. The series of still images shows the same drop 23 at different times; the temperature is held at T=305° C. The dashed circles illustrate deviations of the projected drop shape from the spherical shape found at higher temperature. The arrows mark extended planar surface facets 20.

A Fourier transform (FT) of the area shown in FIG. 2A appears in FIG. 3A. Note the transient faceted drop 23; the temperature was held at T=305° C. FIG. 3B is a FT of the adjacent Ge nanowire (not shown) in the same image, also taken at T=305° C. Diffraction spots 21 corresponding to Ge(113) fringes are clearly seen. FIG. 3C shows the FT of the zeptoliter drop 23 after crystallization (285° C.), while that of the Ge nanowire appears in FIG. 3D. The dashed circles indicate spatial frequencies of (2/0.15 nm) and (2/0.3 nm), respectively. The white squares 21 and circles 22 mark spots arising from Ge(113) fringes (0.191-nm spacing) and Au(111) fringes (0.235 nm), respectively.

Faceting is considered one of the hallmarks of the crystalline state. Stable facets with low specific surface free energy determine the equilibrium shape of small solid particles. The occurrence of planar facets on a liquid drop is highly unusual, as it requires an anisotropic surface free energy not generally found in liquids. The conclusion is that supercooled nanoscale $Au_{72}Ge_{28}$ drops close to crystallization develop some degree of ordering, at least locally in the areas showing transient faceting. An arrangement of near-surface atoms in layers, even without long-range order in the layers, would produce a cusp in the surface energy and would hence be sufficient to induce faceting. Surface layering in liquids has been found near macroscopic planar liquid-vapor interfaces of a wide range of metal and alloy melts, including liquid Ga, eutectic BiSn, AuSi, and AuGe. For binary alloys, segregation of the component with lower surface tension to the outermost layers typically accompanies and may consequently affect liquid-state surface layering. Layering due to surface compression has been predicted for melts of heavy noble metals, again in a planar geometry.

An extended planar liquid surface provides a natural template for surface layering. For layering to occur in a drop, its spherical symmetry needs to be lifted first. The inventors' observations suggest that this process occurs quite readily, probably by small fluctuations of the drop shape creating microscopic planar areas, which then develop into extended facets. The energy cost of forming a planar surface segment on a spherical drop can be estimated as the product of the increase in surface area and the specific surface free energy, $\gamma$, of the fluid. The generation of a small planar area, a few nanometers in diameter, on a 30- to 40-nm drop would increase the surface energy only by about 200 meV, that is, would occur spontaneously at the temperatures considered here. Forming the actual 11-nm-diameter facet 20 shown in FIG. 2A would cause much larger (>10 eV) increases in surface energy, that is, would be exceedingly improbable to occur as a fluctuation but would require additional stabilization, for example, by near-surface layering.

Occurring entirely in the liquid state, the dynamic surface faceting of supercooled drops is clearly distinct from a previously proposed quasi-molten state, a liquid-solid transition regime in which a crystalline cluster can fluctuate in time between different structures. Distinct quasi-melting was not observed, probably owing to the large size of our AuGe drops, which would narrow the phase space in which structure fluctuations can occur. In the absence of fluctuations in the solid state, a comparison of the drop shape during transient faceting with the frozen-in shapes of subsequently crystallized clusters can be used to explore the role of transient surface faceting in the crystallization process.

In all cases in which liquid $Au_{72}Ge_{28}$ drops could be maintained in a state of transient surface faceting, a further reduction of the temperature induced freezing into a cluster shape containing large faceted segments that match the projection of an icosahedral cluster (FIGS. 4A and 4B). Surface facets coincide closely with the last set of transient facets present when crystallization was induced (FIG. 2C). On the other hand, suspended drops were occasionally observed to make contact with and wet the carbon shell at the pipette tip, as shown in FIG. 4C, or other reservoir opening. Such drops could not be stabilized in a transient faceted state, and invariably crystallized in a shape closely matching a suitably oriented truncated octahedron, indicative of a face-centered cubic (fcc) cluster (FIGS. 4C and 4D). Given the preference of larger Au nanoclusters for the stable fcc structure, the formation of facets with icosahedral symmetry strongly suggests crystallization originating at close-packed (111)-like surface planes, that is, a surface-induced crystallization templated by the transient surface facets of 'free' liquid drops. Conversely, the truncated octahedral shape resulting from the freezing of 'supported' drops is consistent with a crystallization front spreading from a single nucleus, probably at the drop-support interface, and hence producing a monocrystalline fcc cluster.

Experiments on a specific model system—spherical $Au_{72}Ge_{28}$ drops dispensed from and suspended by zeptoliter pipettes—provide direct microscopic evidence of long-term dynamic surface faceting of supercooled liquid drops, acting as a template for surface-induced crystallization. These findings challenge a key assumption of the accepted theory of crystallization, classical nucleation theory: the concept of a stable nucleus aggregating spontaneously and initiating solidification from the interior of a drop. Qualitatively similar behavior, albeit on much shorter timescales, has been predicted recently in numerical simulations of the quenching of small Au drops. Ordering effects in the liquid phase that can stabilize large facets on liquid drops, such as near-surface layering, have been found for a wide range of metal and metal-alloy systems. A nucleationless surface crystallization pathway involving liquid-state faceting may therefore govern the crystallization of nanometer-sized metal and metal-alloy drops in general, and possibly the freezing of small drops of a wide range of other fluids.

FIG. 4A is a TEM image of a crystalline cluster 24 that underwent extensive transient surface faceting in the liquid state. FIG. 4B shows a projection of the icosahedral motif 25 bounded by (111) facets, oriented to match the facets in the upper left section of the cluster shown in FIG. 4A. FIG. 4C is an image of a crystalline cluster 26, which in the liquid state showed wetting interactions with the carbon shell 27 at the pipette tip 28. FIG. 4D is a projection of the truncated octahedral (face-centered cubic, fcc) motif 29.

While the function of the zeptoliter pipette has been described largely with reference to scientific study of naturally occurring phenomena, there are practical applications as well. For example, by stabilizing a droplet in a particular symmetry, it may be possible to deposit droplets and/or seed the growth of materials in a chosen crystal structure, possibly even metastable or unstable structures. Drops may be deposited in desired arrangements on desired substrates using this method to create arbitrarily shaped structures with electrical, optical, magnetic, or other properties of interest.

In some embodiments the pipette may act to affect fluid flow. The carbon shell encompassing the pipette/reservoir ensemble may be tightened by irradiation with an electron beam, increasing pressure on the reservoir and the material contained in it. A channel may be opened through the carbon shell into the reservoir at a desired location. Fluid flow may be initiated in a desired direction by the action of the relaxing carbon shell and the placement and shape of the channel. More than one channel may be formed in the pipette shell, in the area of the reservoir, external to the area of the reservoir, or both.

Methods

The methods described herein make use of specific materials and apparatus solely for the sake of clarity. No endorsement of any machine or composition is intended or implied by the mention of a brand name or model identifier. Those skilled in the art will no doubt be able to substitute alternate apparatus of substantially similar capabilities without departing from the scope of the invention.

Transmission Electron Microscopy

Experiments described with reference to FIGS. 1-4 were carried out in a JEOL 3000F field-emission TEM equipped with a Gatan 652 high-temperature specimen holder with a temperature range between room temperature and 1,000° C. The specimen temperature was measured by a type-R thermocouple (Pt—Pt13% Rh) and was electronically controlled with a stability of about 1° C. Specimens consisted of Ge nanowires dispersed on ultrathin amorphous carbon films supported by standard copper grids. In situ TEM observations were carried out at temperatures up to 500° C. in high vacuum (below $2\times10^{-5}$ Pa), and at electron irradiation intensities during imaging between <2 and up to 50 A $cm^{-2}$. High-resolution TEM images were recorded electronically using a 1,024×1,024 pixel charge-coupled device camera and Gatan Digital Micrograph software.

Fabrication and Operation of Zeptoliter Pipettes

Zeptoliter pipettes may be assembled in situ in the TEM from Ge NWs grown in an ultrahigh-vacuum environment from germane ($GeH_4$) on Au catalyst particles dispersed on silicon substrates. At elevated temperature (about 400° C.) and in the presence of carbon (from the amorphous carbon support), the Au in the catalyst particles and small Au aggregates on the NW surface drive the complete encapsulation of the NW and Au-rich tip into a multilayer shell of graphene fragments. This process produces a pipette reservoir consisting of a Au—Ge alloy in contact with a crystalline Ge NW, and surrounded by a graphitic carbon shell. Annealing at temperatures above the eutectic temperature (400-420° C.) of a bulk Au—Ge binary alloy is used to adjust the Ge concentration in the reservoir. In situ energy-dispersive X-ray spectroscopy analysis (measured after cooling to room temperature) may be used to confirm compositions of the alloy melt in the reservoir and of the expelled drop which, in this case, were very close to the Au—Ge eutectic composition (28 atomic % Ge). Electron irradiation was used to tighten the curved carbon shell and build up pressure on the pipette reservoir.

With the sample held at the same temperature (liquid Au—Ge alloy in the pipette reservoir), the electron beam is focused into a tight spot below 2 nm and preferably below 1 nm in diameter for a fraction of a second, which opens a channel in the tip and triggers the expulsion of a melt drop. The further dispensing of the drop is imaged by TEM at low electron intensity (<2 A $cm^{-2}$).

Fitting of the Measured Drop Size Evolution

From time-lapse TEM images of drop expulsion, $R_{Drop}(t)$ was determined and the expulsion rate dV/dt computed as a function of drop radius. A least-squares fit of the early-stage dV/dt(R) to the Hagen-Poiseuille equation, $(dV/dt)=(\pi r^4/8\mu l)(p_{res}-(2\beta/R))$, was carried out for fixed surface tension=1 N $m^{-1}$. A best fit to the experimental data was obtained for reservoir pressure $p_{res}$=7.7108 Pa and viscosity=8105 Pa s.

While the foregoing description has been made with reference to individual embodiments of the invention, it should be understood that those skilled in the art, making use of the teaching herein, may propose various changes and modifications without departing from the invention in its broader aspects. For example, the NW pipette body may be metallic or insulating rather than semiconducting. In another embodiment, the reservoir may be filled with elemental melts or ternary and higher alloys rather than the binary alloys of the description. The foregoing description being illustrative, the invention is limited only by the claims appended hereto.

The invention claimed is:

1. An apparatus comprising:

a nanowire having a body and an outer surface;

the nanowire having a body length of about 10 nanometers to about 1 micrometer;

the nanowire having a diameter of about 0.1 nanometers to about 100 nanometers;

a reservoir at a position along the nanowire and in contact therewith, operable to contain material to be dispensed;

a carbon shell encapsulating at least a part of the nanowire, the carbon shell comprising at least one layer of graphene;

wherein in a storage mode, the apparatus is adapted to store the material to be dispensed, comprising a carbon shell fully encapsulating the reservoir, the carbon shell comprising at least one layer of graphene, and wherein in a dispensing mode, the apparatus is operable to dispense droplets of the material, further comprising a channel formed in the carbon shell encapsulating the reservoir, the channel having a diameter of from approximately 0.5 nanometers to approximately 20 nanometers.

2. The apparatus of claim 1, wherein:

each carbon shell has a thickness of about 0.5 nanometers to about 20 nanometers.

3. The apparatus of claim 1, wherein:

each carbon shell comprises about 1 to about 20 layers of graphene.

4. The apparatus of claim 1, wherein:

the carbon shell encapsulating the nanowire and the carbon shell encapsulating the reservoir comprise parts of the same carbon shell.

5. The apparatus of claim 1, wherein:

the dispensed droplets have volumes from about 0.1 zeptoliters to about 50 zeptoliters.

6. The apparatus of claim 1, wherein:

the dispensed droplets have diameters from about 1 nanometer to about 50 nanometers.

7. The apparatus of claim 1, wherein:

a material to be dispensed fills at least a portion of the reservoir.

8. The apparatus of claim 1, wherein:

at least part of a material to be dispensed is contained within the reservoir.

9. The apparatus of claim 1, wherein:

the apparatus is formed in situ in an observation system.

10. A method for making a pipette, the method comprising:

forming a graphene shell around at least part of a nanowire, comprising:

seeding growth of the graphene shell on a plurality of metal islands on a surface of a nanowire;

initiating growth of graphene at the metal islands;

monitoring a thickness of the shell; and terminating growth of graphene when the thickness of the shell achieves a desired value, opening a channel in the graphene shell, the channel having an approximate diameter of about 0.1 nanometers to about 5 nanometers;

wherein the graphene shell comprises at least one layer of graphene that is in contact with the nanowire.

11. The method of claim 10, wherein:

terminating the growth comprises terminating the growth when the thickness of the shell reaches from about 1 nanometer to about 20 nanometers.

12. A method for making a pipette, the method comprising:

forming a carbon shell around at least part of a nanowire, the carbon shell comprising at least one layer of graphene; and opening a channel in the shell, the channel having an approximate diameter of about 0.1 nanometers to about 5 nanometers, wherein opening a channel in the shell comprises:

focusing a high-energy beam onto a spot on the shell encapsulating a reservoir, the energy of the beam sufficient to remove the shell in a region comprising the spot.

13. The method of claim 12, wherein:

focusing the beam comprises focusing the beam to a spot size of about 1 nanometer.

14. The method of claim 12, wherein:

the high-energy beam is a high-energy beam of electrons.

* * * * *

UNITED STATES PATENT AND TRADEMARK OFFICE

CERTIFICATE OF CORRECTION

PATENT NO. : 7,972,560 B2
APPLICATION NO. : 12/102370
DATED : July 5, 2011
INVENTOR(S) : Sutter et al.

It is certified that error appears in the above-identified patent and that said Letters Patent is hereby corrected as shown below:

1. In item (75) on the title page, "Beach, NY (US)" is replaced with --Westhampton Beach, NY (US)--

Signed and Sealed this
Thirteenth Day of September, 2011

David J. Kappos

David J. Kappos
*Director of the United States Patent and Trademark Office*